US009226636B2

(12) United States Patent
Landwehr

(10) Patent No.: US 9,226,636 B2
(45) Date of Patent: Jan. 5, 2016

(54) SCRAPER HAND TOOL

(71) Applicant: Thomas Jay Landwehr, Green Bay, WI (US)

(72) Inventor: Thomas Jay Landwehr, Green Bay, WI (US)

(73) Assignee: Ritesafety Product International, LLC, Green Bay, WI (US)

( * ) Notice: Subject to any disclaimer, the term of this patent is extended or adjusted under 35 U.S.C. 154(b) by 157 days.

(21) Appl. No.: 13/851,634

(22) Filed: Mar. 27, 2013

(65) Prior Publication Data

US 2014/0290070 A1 Oct. 2, 2014

(51) Int. Cl.

| | |
|---|---|
| ***A47L 13/08*** | (2006.01) |
| ***B26B 1/08*** | (2006.01) |
| ***B26B 5/00*** | (2006.01) |

(52) U.S. Cl.

CPC . *A47L 13/08* (2013.01); *B26B 1/08* (2013.01); *B26B 5/003* (2013.01)

(58) Field of Classification Search

None

See application file for complete search history.

(56) References Cited

U.S. PATENT DOCUMENTS

| | | | | | |
|---|---|---|---|---|---|
| 4,558,517 | A * | 12/1985 | Gringer | 30/169 |
| 5,342,379 | A * | 8/1994 | Volinsky | 606/167 |
| 5,433,004 | A * | 7/1995 | Thompson et al. | 30/169 |
| 5,528,832 | A * | 6/1996 | Schmidt | 30/169 |
| 6,026,574 | A * | 2/2000 | Ghavami et al. | 30/109 |
| 6,161,290 | A * | 12/2000 | Takamasa | 30/162 |
| 6,418,624 | B1 * | 7/2002 | Huang | 30/162 |
| 6,500,187 | B1 * | 12/2002 | Petersen | 606/167 |
| 6,775,911 | B2 * | 8/2004 | Tremblay | 30/162 |
| 6,775,912 | B2 * | 8/2004 | Panfili et al. | 30/169 |
| 7,540,092 | B2 * | 6/2009 | Polei | 30/162 |
| 8,171,646 | B2 * | 5/2012 | Chiu | 30/169 |
| 2009/0277016 | A1 * | 11/2009 | Wu | 30/162 |
| 2014/0290070 | A1 * | 10/2014 | Landwehr | 30/169 |

* cited by examiner

*Primary Examiner* — Hwei C Payer

(57) ABSTRACT

A scraper hand tool with a retractable scraper blade, allowing the scraper blade to be moved in and out of a protected position, by including springs, which provide the force required for automatically moving the scraper blade from the extended to the retracted position.

4 Claims, 4 Drawing Sheets

SCRAPER HAND TOOL

FIELD OF THE INVENTION

The present invention relates to a scraper hand tool with a retractable scraper blade, allowing the scraper blade to be moved in and out of a protected position.

BACKGROUND OF THE INVENTION

Scrapers are commonly used for cleaning surfaces especially for removing paint, adhesives or other materials from surfaces which are essentially flat and smooth. For many years scrapers have been known with blades that can be moved between an extended position when in use and a protected or retracted position when not is use. Examples of such scrapers are shown in U.S. Pat. No. 4,558,517 or U.S. Pat. No. 4,955,138.

The common solution for moving the scraper blade between the extended and the retracted position is a trigger that can be located at the top of the scraper. This trigger is connected to a movable part of the scraper which is securely connected to the scraper blade. This allows the scraper blade to be moved in and out of the scraper casing by operating the trigger forward and back on the tool. The trigger is operated by using the thumb or another finger and requires the operator to apply pressure to move the trigger forward. In order to prevent the user from the need of exerting a permanent force on the trigger to keep the scraper blade in the extended position a lock mechanism is commonly used, which keeps the scraper blade in the extended position until the task is finished and the scraper blade can be stowed back into the retracted position. Depending on the type of mechanism used for locking the scraper in the extended position an additional force is required to move the scraper blade into and out of this position. For example it may be required to use the second hand to turn a knob fixing the scraper blade in the extended position as shown in U.S. Pat. No. 8,291,598. Alternately the trigger may be constructed in a way that it contains a mechanism that locks in either the retracted or the extended position as shown in U.S. Pat. No. 8,171,646. In this case the scraper blade slide must be disengaged by applying an additional force on the trigger for moving the scraper blade slide.

In U.S. Pat. No. 6,775,912 a solution is shown where only one trigger is used for moving the scraper blade slide from the retracted to the extended position and back. In this case an additional force perpendicular to the moving direction of the scraper blade is required to disengage the scraper blade slide from one of the two predefined positions before it can be moved to the other position.

In cases where the scraper is operated back and forth between the extended and the retracted position many times the operators thumb and fingers will tire quickly, as a force must be applied in forward and downward for moving the scraper blade to the extended position for using the scraper hand tool and backward and downward again after use for storing the scraper blade back in the protected position. Also as the scraper blade must be actively moved back to the retracted position, it is likely the operator will leave the scraper blade in the extended position, thus increasing the risk of injury.

SUMMARY OF THE INVENTION

The main object of the present invention is to provide an improved scraper hand tool addressing the described deficiencies in currently known scrapers, by including springs, which provide the force required for automatically moving the scraper blade from the extended to the retracted position.

DETAILED DESCRIPTION OF THE INVENTION

A preferred embodiment of a scraper hand tool is described according to the drawings. This preferred embodiment is to be understood as an exemplary embodiment and any detailed description shall not be interpreted as limiting. Alternate embodiments obvious to one skilled in the art will not be described in detail or will be omitted to prevent the relevant details of the invention to be overlooked.

Figure 1:
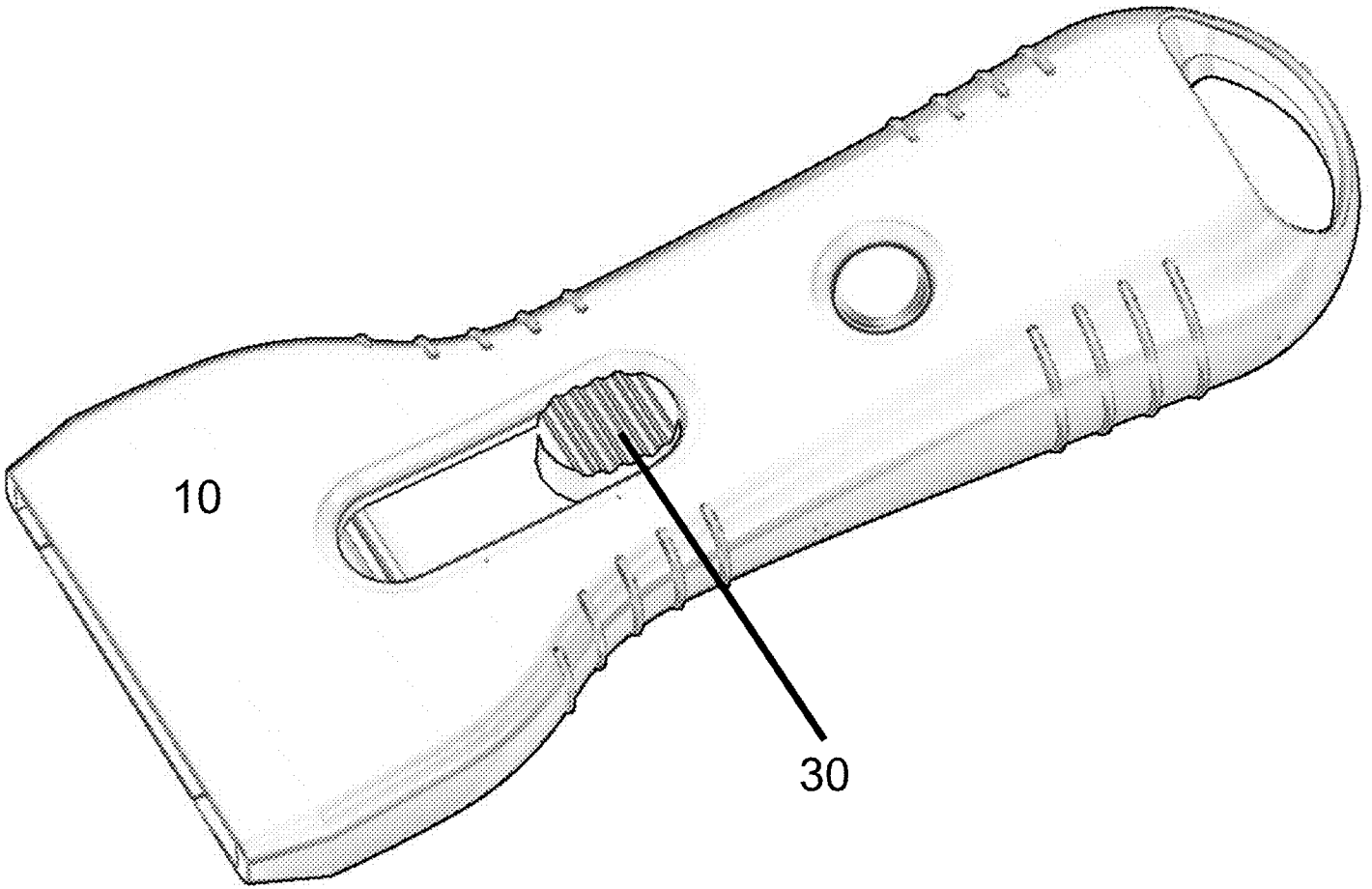
FIG. 1 is a perspective view of the scraper hand tool.
Figure 2:
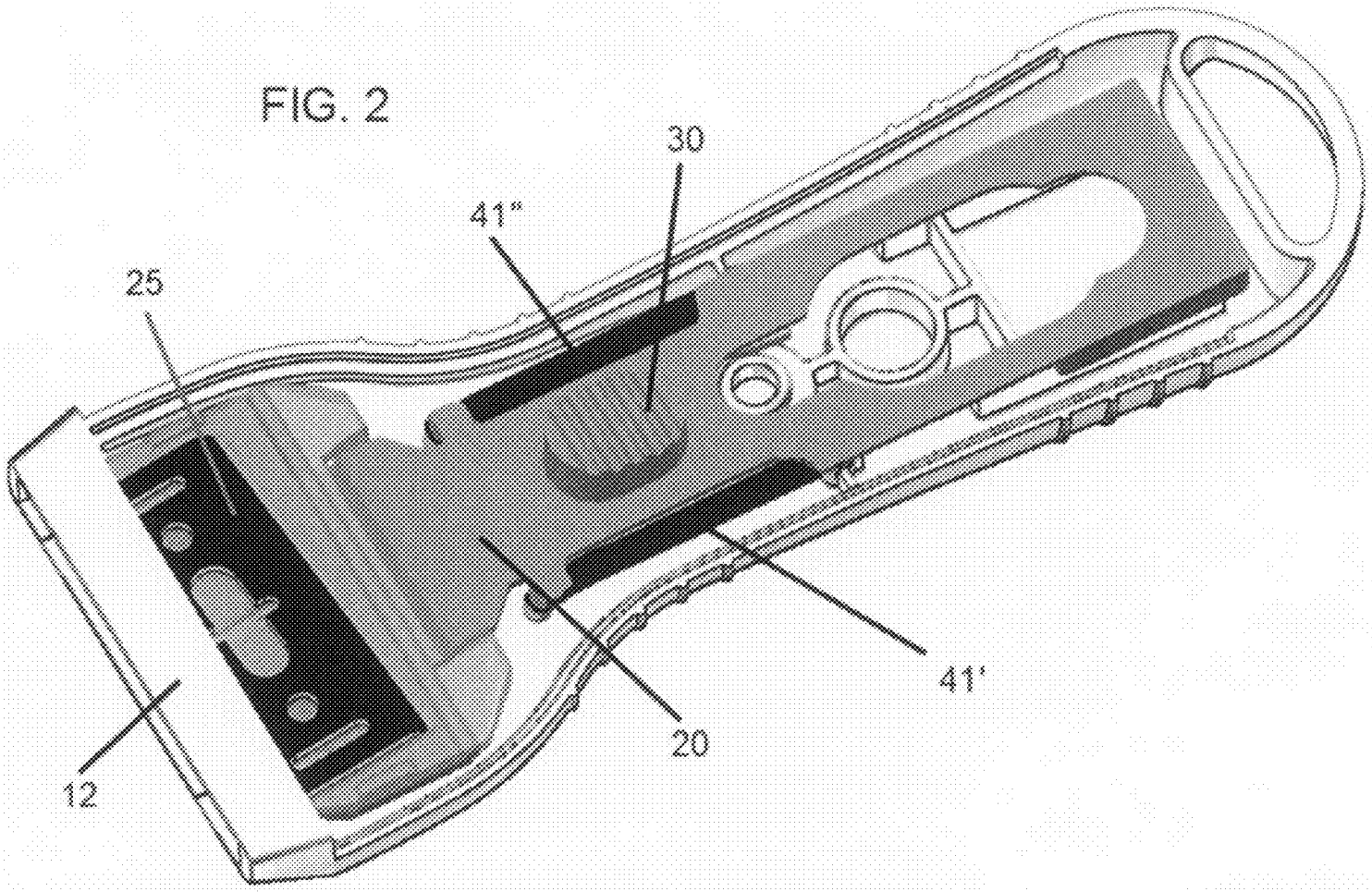
FIG. 2 is a view of the scraper tool with the top part of the housing removed where the scraper blade is in the retracted position.
Figure 4:
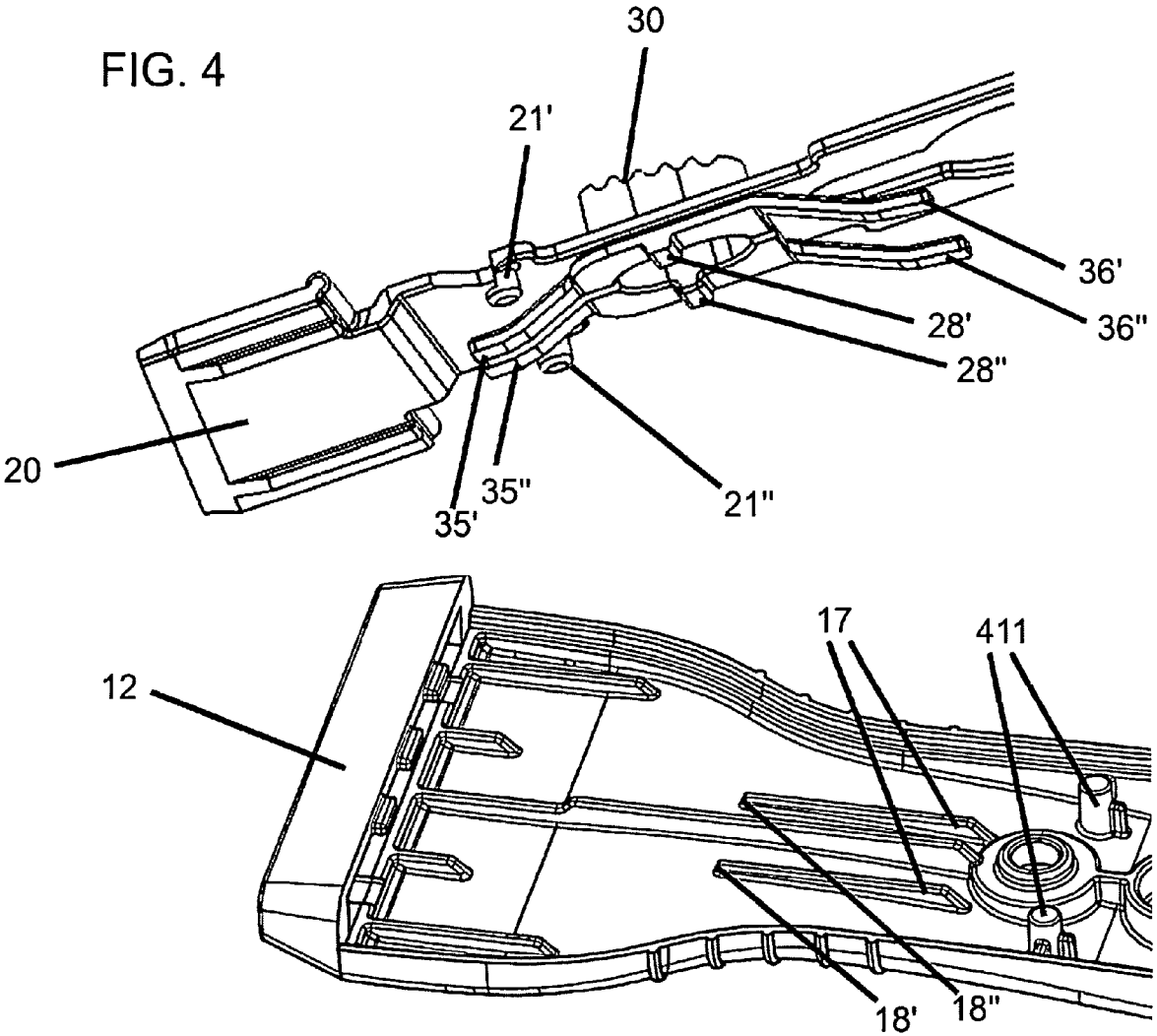
FIG. 4 is a partial view of the scraper blade slide and the bottom part of the housing.

FIG. 1 shows the complete scraper hand tool with the housing 10 and the trigger button 30 in the protected position, where the scraper blade is concealed. This is the position used for storing and transporting the tool since it prevents possible scratching or injuries caused by the scraper blade. The same protected position is shown in FIG. 2 with the top part of the housing removed so that the scraper blade slide 20 and the scraper blade 25 can be seen in the bottom part of the housing 12. The trigger button 30 is connected to the scraper blade slide 20, so that any forward movement of the trigger button 30 causes the scraper blade slide 20 and the scraper blade 25 to move forward and out of the front opening of the bottom part of the housing 12. Springs 41', 41" are attached to the scraper blade slide 20 towards the front of the tool with hooks 21', 21" as shown in FIG. 4 and with the bottom part of the housing 12 in the rear part of the tool.

Figure 3:
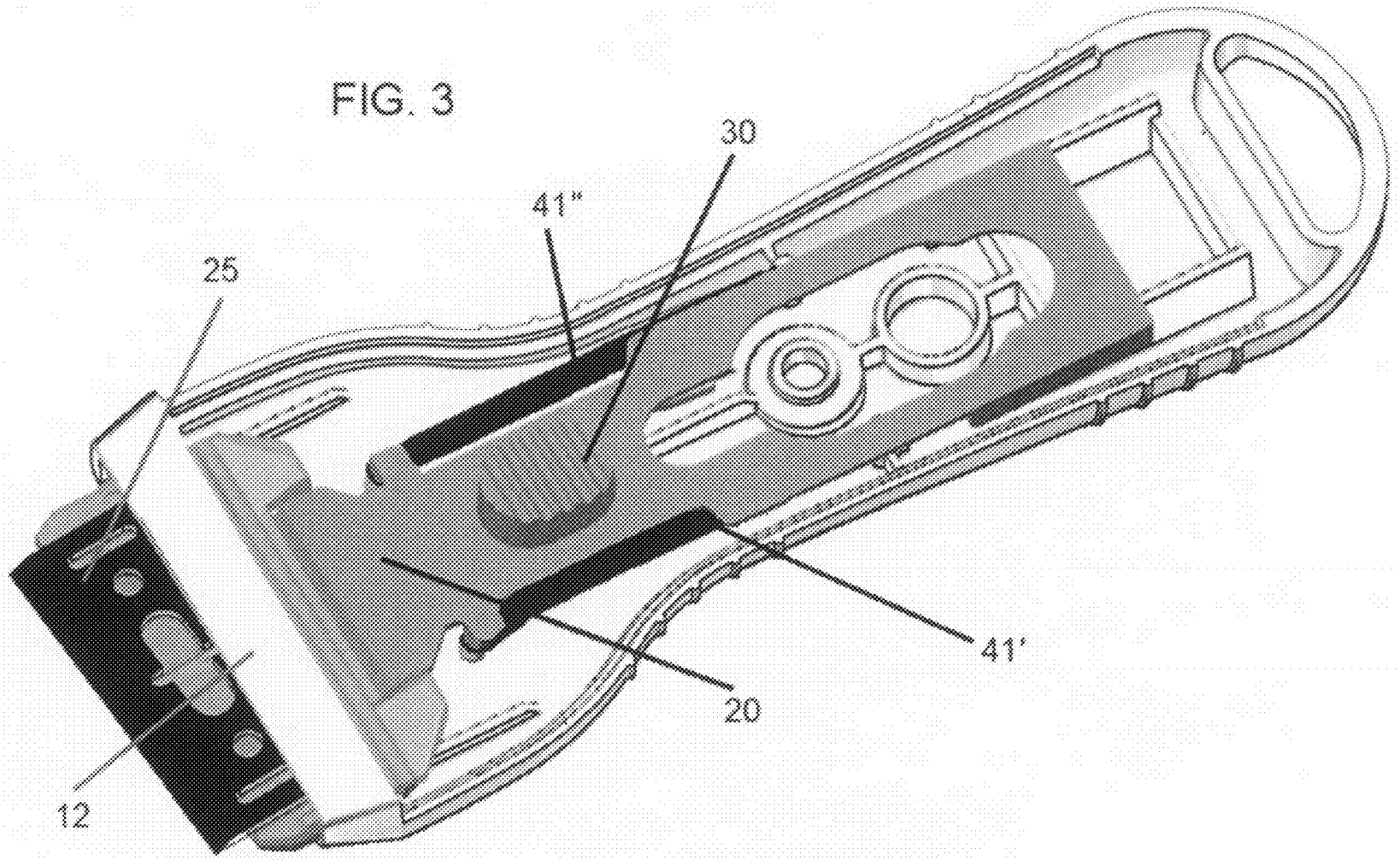
FIG. 3 is a view of the scraper tool with the top part of the housing removed where the scraper blade is in the extended position.

When the user moves the trigger button 30 forward to expose the scraper blade 25, so that it can be used, the springs 41',41" are stretched as can be seen in FIG. 3. The springs 41',41" therefore provide a permanent force pulling the scraper blade slide 20 back to the protected and safe position. This safety feature prevents the scraper blade 25 from remaining in the extended position whenever the trigger button 30 is released, thus preventing unintentional scratching of objects and injuries.

In a further embodiment the tool is improved in a way to enable the user to use the scraper hand tool eliminating any forces in the backward direction transmitted through the scraper blade slide 20 from the action of scraping. Two bulges 28', 28" are formed on the bottom of the scraper blade slide 20 below the trigger button 30 as shown in FIG. 4. When the scraper blade slide 20 is pushed forward by the trigger button 30 these bulges 28', 28" move forward to the position of detents 18',18" in guide ramps on the bottom part of the housing 12. By providing a downward force to the scraper blade slide 20 in the extended position the bulges 28', 28" interlock with the detents 18', 18", so that no backward force is exerted through the scraper blade slide 20 to the trigger button 30 and to the thumb of the user. A set of spring fingers 35', 35", 36', 36" located under the trigger button 30 force the scraper blade slide 20 and with it the bulges 28', 28" upwards as soon as the downward force on the trigger button 30 stops when the user releases the trigger button. This upwards movement disengages the bulges 28', 28" from the detents 18', 18" and allows the springs 41', 41" to pull back the scraper blade slide 20 into the protected position. This leads to an automatic retraction of the scraper blade 25 to the protected position as soon as the trigger button 30 is released.

This description and the accompanying drawings show exemplary embodiments of the invention. The invention, however, should not be interpreted as being limited to these particular embodiments. Variations of the embodiments can be made by those skilled in the art without departing from the scope of this invention as defined by the claims.

The invention claimed is:

1. A scraper hand tool comprising:

a housing made of two parts, an upper housing part and a lower housing part, a scraper blade slide slidably mounted in the housing, on which a scraper blade can be mounted at a front end of the housing, a trigger assembly consisting of a trigger button connected to the scraper blade slide, enabling the movement of the scraper blade slide between two positions, a first position in which the scraper blade is totally contained within the housing and the second position in which a scraper blade is ready for use outside the housing, a spring assembly is connected to said scraper blade slide and to said housing and permanently forcing the scraper blade slide to said first position, said spring assembly including at least one spring, a mechanism for interlocking the scraper blade slide with the housing in the second position against the force exerted by said spring assembly, said interlocking mechanism containing at least one bulge on the scraper blade slide and at least one detent in a guide ramp of the housing that interlock as soon as the trigger assembly is in the second position and a force perpendicular to the force exerted by the spring assembly towards the back of the scraper hand tool is applied to a trigger assembly, said Interlocking mechanism including additionally at least one spring mechanism, wherein said spring mechanism forces said bulge away from said detent thus disengaging the scraper blade slide from the detent as soon as the trigger button is released.

2. The scraper hand tool of claim 1 wherein said spring assembly consists of two springs located at equal distances from a central longitudinal axis of the tool.

3. The scraper hand tool of claim 2 wherein said spring mechanism includes at least one spring finger located below the trigger button.

4. The scraper hand tool of claim 1 wherein said spring mechanism includes at least one spring finger located below the trigger button.

* * * * *